United States Patent [19]

Rice

[11] 4,305,579

[45] Dec. 15, 1981

[54] EXERCISING DEVICE

[76] Inventor: Max Rice, 1140 Sutter St., Apt. 406, San Francisco, Calif. 94109

[21] Appl. No.: 181,113

[22] Filed: Aug. 25, 1980

[51] Int. Cl.[3] ..... A63B 23/02

[52] U.S. Cl. ..... 272/146

[58] Field of Search ..... 272/28 R, 28 S, 33 R, 272/39, 93, 94, 109, 111, 115, 134, 144–146

[56] References Cited

U.S. PATENT DOCUMENTS

| | | | |
|---|---|---|---|
| 3,100,639 | 8/1963 | Bonewitz | 272/146 |
| 3,384,369 | 5/1968 | Rumell | 272/146 X |
| 3,911,907 | 10/1975 | Smith | 272/146 X |
| 3,936,047 | 2/1976 | Brandt et al. | 272/146 |
| 4,132,405 | 1/1979 | Asher | 272/146 |
| 4,153,244 | 5/1979 | Tauber | 272/94 X |
| 4,220,329 | 9/1980 | Agyagos | 272/146 |

FOREIGN PATENT DOCUMENTS

| | | | |
|---|---|---|---|
| 2420826 | 11/1975 | Fed. Rep. of Germany | 272/146 |
| 577226 | 5/1924 | France | 272/146 |

*Primary Examiner*—Richard J. Apley
*Attorney, Agent, or Firm*—Richard L. Miller

[57] ABSTRACT

An apparatus upon which a person can do various different exercises; the apparatus including a stationary base having two posts with handgrips, a rotatable platform between the posts, adjustable weights upon the platform, two rotatable inclined pads stationarily located on the platform for standing upon, a head brace supported on the posts, and an upwardly pull cord from a center of the platform for causing it to rotate.

3 Claims, 7 Drawing Figures

EXERCISING DEVICE

BACKGROUND OF THE INVENTION

It is well known that numerous exercising devices of all kinds have been developed in the past, however none of them appear to provide the various torso-twisting exercises that are so beneficial to good health and maintainance of a youthful appearance.

SUMMARY OF THE INVENTION

Accordingly it is a principal object of the present invention to provide an exercising device which enables a person to perform a great variety of torso-twisting exercises that develop the muscles of the torso, legs, feet, arms, hands and neck and thus keep the same healthy and looking well.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

Figures 1, 2, 3, 3A, 4, 5, 6:
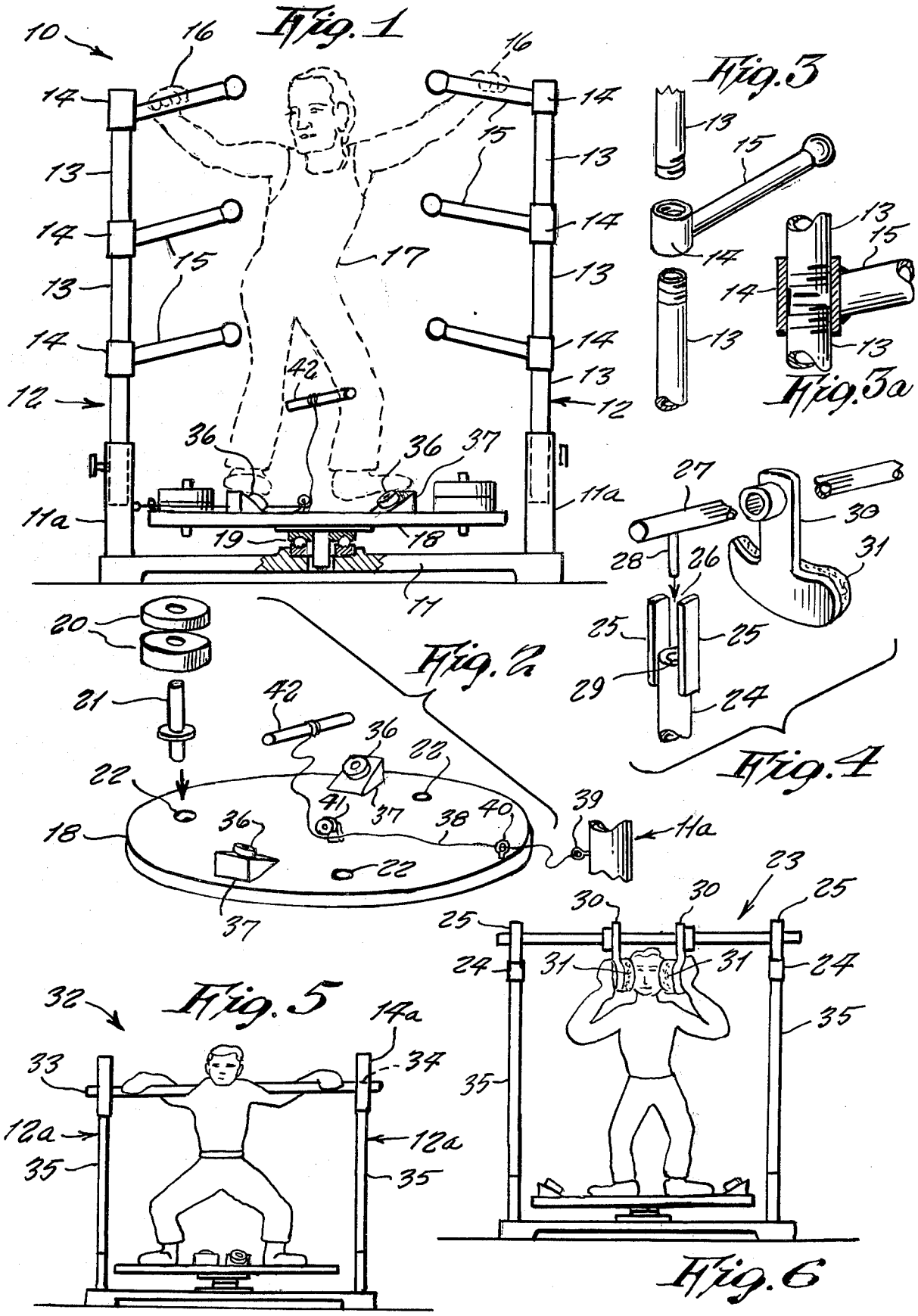
FIG. 1 is a front view of the invention shown assembled for a specific exercise.
FIG. 2 is a perspective view of the rotatable platform, showing some of the adjustable weights mountable thereupon.
FIG. 3 is a detail of the stanchion structure shown in FIG. 1.

FIG. 3*a* is a cross sectional assembly thereof.

FIG. 4 is a detail for an alternate structure for doing different exercises.

FIG. 5 shows the device assembled for a different exercise.

FIG. 6 shows the invention assembled for still another exercise.

DETAILED DESCRIPTION OF PREFERRED EMBODIMENTS

Referring now to the drawing in greater detail, the reference numeral 10 represents an exercising device, according to the present invention, wherein there is a stationary base 11 for resting upon a floor or ground. An upstanding post or stanchion 12 at opposite ends of the base is comprised of a plurality of sections 13 screw threaded into opposite ends of sleeves 14 therebetween, each sleeve having an angularly sideward handgrip 15 for selectively being grasped in a hand 16 of a person 17 standing upon a circular, rotatable platform 18 located between the two posts or stanchions, and supported on a thrust bearing 19 mounted on a center of the base.

An adjustable number of different sized weights 20 may be fitted upon pegs 21 fitted in three holes 22 near a periphery of the platform and located one hundred twenty degrees apart.

In operative use, a person standing on the platform, may selectively grasp the handgrips and then with his feet rotate the platform back and forth in opposite directions so as to produce a torso-twisting exercise in which also the muscles of legs, feet, arms and hands participate. By adding weights 20, the momentum force is increased, so as to require a greater force application by the person to stop the platform rotation in one direction and start it in an opposite direction, so as to continue to challange the person as he continues to develop strength.

An accessory 23 mountable across a top of the stanchions, includes a pair of top threaded sections 24, each of which has a pair of upward extending plates 25 on opposite sides thereof so as to form a slot 26 therebetween and into which a horizontal bar 27 is slidably fitted, a pin 28 on the bar sliding into a hole 29 of the top section 24 in order to prevent the bar from rotating. A pair of brackets 30 are splined on the bar, each bracket extending downward. A soft pad 31 is on each bracket, so that person's head may be stationarily held between the pads, as shown in FIG. 6, while performing the above-indicated exercises, so as to thus also exercise the neck muscles.

In FIG. 5, another accessory 32 includes a straight bar 33 which at its opposite ends is supported in sleeves 14*a* having a transverse hole 34 for receiving the same. The sleeve 14*a* may be supported on stanchions 12 such as shown in FIG. 1 or else upon stanchions 12*a* comprised of any length, single pipes 35. As shown in FIG. 5 still other exercises may thus be done on the apparatus.

A pair of caster-like, freely rotatable circular pads 36, are mounted on an inclined platform 37, so as to allow a person to stand thereupon for a further challenge while trying the various exercises.

Additionally, a pull cord 38, tethered at one end to an eye bolt 39 on one of the stanchion sockets 11*a*, extends through a second eye bolt 40 mounted upon a periphery of the platform and then around a pully mounted at the center of the platform, an opposite end of the cord being attached to a handle 42 which may be upwardly pulled by a person so as to impart a rotational movement to the platform while producing a back-bending exercise. In a modified design, two such cords and handles could be used, each cord being tethered to a different of the stanchions, and each handle being held in a different hand. In such case, the eye bolts 40 are diametrically disaligned on the platform so that at least one of them is always positioned so as to be pulled toward the stanchion.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. An exercising device comprising, in combination, a stationary base; a pair of upstanding stanchions on opposite ends said base; a platform rotatably mounted on said stationary base between said pair of stanchions upon which an exerciser stands during an exercise; means for rotatably mounting said rotatable platform on said stationary base, said means providing free rotation thereof; said rotatable platform having at least one hole formed therethrough, and at least one peg for reception in said at least one hole, said at least one peg having a lower elongated portion matingly engaging in said at least one hole, a flange portion for abutting against the top surface of said rotatable platform, and an upper elongated portion extending upwardly from said flanges; weight means having a central aperture formed therein for passage therethrough of said upper elongated portion of said at least one peg to thereby mount said weight means on said rotatable platform to increase the inertia thereof, a pair of footrests mounted on said top surface of said rotatable platform, said pair of footrests being mounted opposite each other and each comprising a base having a top inclined ramp portion, and a pad freely rotatable on said top inclined ramp portion where the exerciser places his feet; each of said pair of stanchions comprising a plurality of removable sections, each said section having a first threaded end and a second threaded end, and a plurality threaded sleeves interposed between respective ends of said sections for combining said sections together, the upper-most of said plurality of sections having a central aperture formed in the top portion thereof, and a pair of plates mounted at said top portion of said upper-most section on opposite sides thereof to form therebetween a channel projecting outwardly beyond said top portion of said upper-most section; a cross bar having a first end and a second end remote from said first end, each of said first and second ends being mounted in said channel formed between said pair of plates, each of said first and second ends further having a projecting pin extending downwardly for mating reception in a respective central aperture of said upper-most section of each said stanchion; a first bracket mounted slidingly on said cross-bar, said first bracket having a downward extension having a cushioning pad mounted thereon, and a second bracket slidingly mounted on said cross-bar also having a downward extension having a cushioning pad mounted thereon, said first and second bracket being spaced apart along said cross-bar whereby the exerciser may adjust said first and second brackets so that said cushions rest upon the sides of the head.

2. The exercising device according to claim 1, wherein each of said plurality of threaded sleeves comprises an angularly upwardly extending bar projecting toward the opposite of said pair of stanchions, said bar serving as a hand grip for the exerciser.

3. The exercising device according to claim 2, wherein said platforms has three said holes formed therethrough spaced 120 degrees apart from each other, and three said pegs for said three holes.

* * * * *